US009983607B2

(12) United States Patent
Murukumpet et al.

(10) Patent No.: US 9,983,607 B2
(45) Date of Patent: May 29, 2018

(54) CAPACITOR-LESS LOW DROP-OUT (LDO) REGULATOR

(71) Applicant: Microchip Technology Incorporated, Chandler, AZ (US)

(72) Inventors: Raghuveer Murukumpet, Doddanekkundi Bangalore (IN); Kent Lawrence, Chandler, AZ (US); Asif Iqbal, Bangalore (IN)

(73) Assignee: MICROCHIP TECHNOLOGY INCORPORATED, Chandler, AZ (US)

( * ) Notice: Subject to any disclaimer, the term of this patent is extended or adjusted under 35 U.S.C. 154(b) by 136 days.

(21) Appl. No.: 14/532,489

(22) Filed: Nov. 4, 2014

(65) Prior Publication Data

US 2016/0124448 A1 May 5, 2016

(51) Int. Cl.

| | |
|---|---|
| ***G05F 1/575*** | (2006.01) |
| ***G05F 1/569*** | (2006.01) |
| ***G05F 1/59*** | (2006.01) |

(52) U.S. Cl.

CPC ..... *G05F 1/59* (2013.01); *G05F 1/569* (2013.01); *G05F 1/575* (2013.01)

(58) Field of Classification Search

CPC ... G05F 1/10; G05F 1/46; G05F 1/462; G05F 1/56; G05F 1/565; G05F 1/569; G05F 1/571; G05F 1/575; G05F 1/59

USPC ..... 323/234, 265, 268, 271

See application file for complete search history.

(56) References Cited

U.S. PATENT DOCUMENTS

| | | | | |
|---|---|---|---|---|
| 6,650,175 | B2 | 11/2003 | Messager | 327/541 |
| 6,914,421 | B2 | 7/2005 | Yamamoto | 323/289 |
| 8,374,008 | B2 | 2/2013 | Rinne et al. | 363/65 |
| 2008/0169795 | A1 | 7/2008 | Wang | 323/280 |
| 2008/0180071 | A1* | 7/2008 | Moraveji | H03K 5/08 323/268 |

(Continued)

FOREIGN PATENT DOCUMENTS

| | | | | |
|---|---|---|---|---|
| CN | 103729003 | A | 4/2014 | G05F 1/46 |
| EP | 1231529 | A1 | 8/2002 | G05F 1/565 |

OTHER PUBLICATIONS

Chong et al., "A 0.9 mircoamp Quiescent Current Output-Capacitor-less LDO Regulator with Adaptive Power Transistors in 65 nanometer CMOS", Apr. 2013, IEEE Transactions on Circuits and Systems—I: Regular Papers, Vo. 60, No. 4, pp. 1072-1081.*

(Continued)

*Primary Examiner* — Jeffrey Gblende
*Assistant Examiner* — David A. Singh
(74) *Attorney, Agent, or Firm* — Slayden Grubert Beard PLLC

(57) ABSTRACT

An integrated circuit including a low drop out (LDO) regulator configured to implement transient response and loop stability in a capacitor-less configuration, including an error amplifier configured to receive a bandgap reference input; first and second pass elements configured to receive outputs from the error amplifier; first and second resistor feedback networks, the first resistor network configured to provide a feedback output as an input to the error amplifier; an overshoot protection circuit; and an output connected to the pass transistors; wherein the capacitor-less low dropout (LDO) regulator is operable without an output capacitor.

24 Claims, 7 Drawing Sheets

(56) References Cited

U.S. PATENT DOCUMENTS

| | | | | |
|---|---|---|---|---|
| 2009/0322429 | A1* | 12/2009 | Ivanov | H03F 3/45179 330/257 |
| 2010/0201331 | A1* | 8/2010 | Imura | G05F 1/56 323/234 |
| 2011/0267017 | A1* | 11/2011 | Zhang | G05F 1/575 323/280 |
| 2013/0062962 | A1* | 3/2013 | Xue | H02J 5/005 307/104 |
| 2013/0088902 | A1 | 4/2013 | Dunipace | 363/97 |
| 2013/0241649 | A1* | 9/2013 | Fort | G05F 1/575 330/253 |
| 2013/0257402 | A1* | 10/2013 | Wang | G05F 1/575 323/282 |
| 2014/0191739 | A1* | 7/2014 | Kim | G05F 1/575 323/280 |
| 2014/0247028 | A1 | 9/2014 | Pons et al. | 323/281 |
| 2014/0266106 | A1* | 9/2014 | El-Nozahi | G05F 1/575 323/280 |

OTHER PUBLICATIONS

Kim, Y.I. et al., "Fast Transient Capacitor-less LDO Regulator Using Low-Power Output Voltage Detector," Electronic Letters, IEEE Stevenage, vol. 48, No. 3, 2 pages, Feb. 2, 2012.

International Search Report and Written Opinion, Application No. PCT/US2015/058583, 17 pages, dated Jun. 6, 2016.

* cited by examiner

CAPACITOR-LESS LOW DROP-OUT (LDO) REGULATOR

TECHNICAL FIELD

The present disclosure relates to low dropout (LDO) regulators and, particularly, to an improved LDO regulator that controls overshoot and undershoot and has improved stability and current consumption without use of an output capacitor.

BACKGROUND

Low dropout (LDO) regulators are DC linear voltage regulators that are commonly used to supply voltages to various components in electronic devices. LDO regulators are characterized by a small input to output differential ("dropout") voltage, high efficiency and low heat dissipation.

Referring to FIG. 1, depicted is a schematic diagram of a conventional low dropout (LDO) voltage regulator 100. The LDO voltage regulator 100 includes a feedback circuit 102 including an error amplifier 110, feedback network 114, a stable voltage reference 108, and pass element 112. The pass element 112 may comprise a FET or BJT transistor.

The purpose of the LDO voltage regulator is to maintain a desired voltage at node VOUT when in a regulation mode of operation. The error amplifier 110 compares a sample of the VOUT voltage, fed via feedback network 114 (i.e., voltage divider comprising resistors 120, 122) into the positive input of the error amplifier 110, with a reference voltage from 108 fed into the negative input of the error amplifier 110.

If the voltage that is fed back is lower than the reference voltage, the pass element 112 increases the output voltage. If the feedback voltage is higher than the reference voltage, the pass element decreases the output voltage.

The input and output capacitors 115, 116 reduce the circuit's sensitivity to noise as well as, in the case of the output capacitor 116, affecting the stability of the control loop and the circuit's response to changes in load current.

Typically, the feedback circuit 102 comprises an integrated circuit, while the input and output capacitors 115, 116 are external to the integrated circuit. The output capacitor 116 may have a value in the microfarad range and thus is relatively large. This can occupy a significant amount of "board space" and may require an output pin from the integrated circuit. Also, a capacitor may be relatively expensive, particularly where a capacitor with a low ESR (equivalent series resistance) is required.

SUMMARY

According to an embodiment, a capacitor-less low drop out (LDO) regulator, includes an error amplifier configured to receive a bandgap reference input; first and second pass transistors configured to receive outputs from the error amplifier; first and second resistor feedback networks, the first resistor network configured to provide a feedback output as an input to the error amplifier; an overshoot protection circuit; and an output connected to the pass transistors; wherein the capacitor-less low dropout (LDO) regulator is operable without an output capacitor. In some embodiments, a driver is coupled between the error amplifier and the output In some embodiments, the second resistor feedback network is configured to provide a comparator feedback output as an input to the overshoot protection circuit. In some embodiments, the overshoot protection circuit includes a comparator configured to compare the comparator feedback output and the bandgap reference input. In some embodiments, the error amplifier comprises a folded cascode amplifier. In some embodiments, the first pass transistor implements a capacitor at the output of the error amplifier to compensate for slow response. In some embodiments, the second pass transistor implements a capacitor coupled to a differential pair input circuit of the folded cascode amplifier.

An integrated circuit including a low drop out (LDO) regulator configured to implement transient response and loop stability in a capacitor-less configuration, according to embodiments includes an error amplifier configured to receive a bandgap reference input; first and second pass elements configured to receive outputs from the error amplifier; first and second resistor feedback networks, the first resistor network configured to provide a feedback output as an input to the error amplifier; an overshoot protection circuit; and an output connected to the first and second pass elements; wherein the integrated circuit is operable to implement the low dropout regulator without an output capacitor. In some embodiments, a driver is coupled between the error amplifier and the output.

In some embodiments, the second resistor feedback network is configured to provide a comparator feedback output as an input to the overshoot protection circuit. In some embodiments, the overshoot protection circuit includes a comparator configured to compare the comparator feedback output and the bandgap reference input. In some embodiments, the error amplifier comprises a folded cascode amplifier. In some embodiments, the first pass element implements a capacitor at the output of the error amplifier to compensate for slow response. In some embodiments, the second pass element implements a capacitor coupled to a differential pair input circuit of the folded cascode amplifier.

A method for providing a low drop out (LDO) regulator configured to implement transient response and loop stability in a capacitor-less configuration, according to embodiments includes providing an error amplifier configured to receive a bandgap reference input; providing first and second pass elements configured to receive outputs from the error amplifier; providing first and second resistor feedback networks, the first resistor network configured to provide a feedback output as an input to the error amplifier; providing an overshoot protection circuit; and providing an output connected to the first and second pass elements; wherein the integrated circuit is operable to implement the low dropout regulator without an output capacitor.

In some embodiments, the method include providing a driver coupled between the error amplifier and the output. In some embodiments, the second resistor feedback network is configured to provide a comparator feedback output as an input to the overshoot protection circuit. In some embodiments, the overshoot protection circuit includes a comparator configured to compare the comparator feedback output and the bandgap reference input. In some embodiments, the error amplifier comprises a folded cascode amplifier. In some embodiments, the first pass element implements a capacitor at the output of the error amplifier to compensate for slow response. In some embodiments, the second pass element implements a capacitor coupled to a differential pair input circuit of the folded cascode amplifier.

These, and other, aspects of the disclosure will be better appreciated and understood when considered in conjunction with the following description and the accompanying drawings. It should be understood, however, that the following description, while indicating various embodiments of the disclosure and numerous specific details thereof, is given by way of illustration and not of limitation. Many substitutions, modifications, additions and/or rearrangements may be made within the scope of the disclosure without departing from the spirit thereof, and the disclosure includes all such substitutions, modifications, additions and/or rearrangements.

BRIEF DESCRIPTION OF THE DRAWINGS

The drawings accompanying and forming part of this specification are included to depict certain aspects of the disclosure. It should be noted that the features illustrated in the drawings are not necessarily drawn to scale. A more complete understanding of the disclosure and the advantages thereof may be acquired by referring to the following description, taken in conjunction with the accompanying drawings in which like reference numbers indicate like features and wherein.

DETAILED DESCRIPTION

The disclosure and various features and advantageous details thereof are explained more fully with reference to the exemplary, and therefore non-limiting, embodiments illustrated in the accompanying drawings and detailed in the following description. It should be understood, however, that the detailed description and the specific examples, while indicating the preferred embodiments, are given by way of illustration only and not by way of limitation. Descriptions of known programming techniques, computer software, hardware, operating platforms and protocols may be omitted so as not to unnecessarily obscure the disclosure in detail. Various substitutions, modifications, additions and/or rearrangements within the spirit and/or scope of the underlying inventive concept will become apparent to those skilled in the art from this disclosure.

Figure 1:
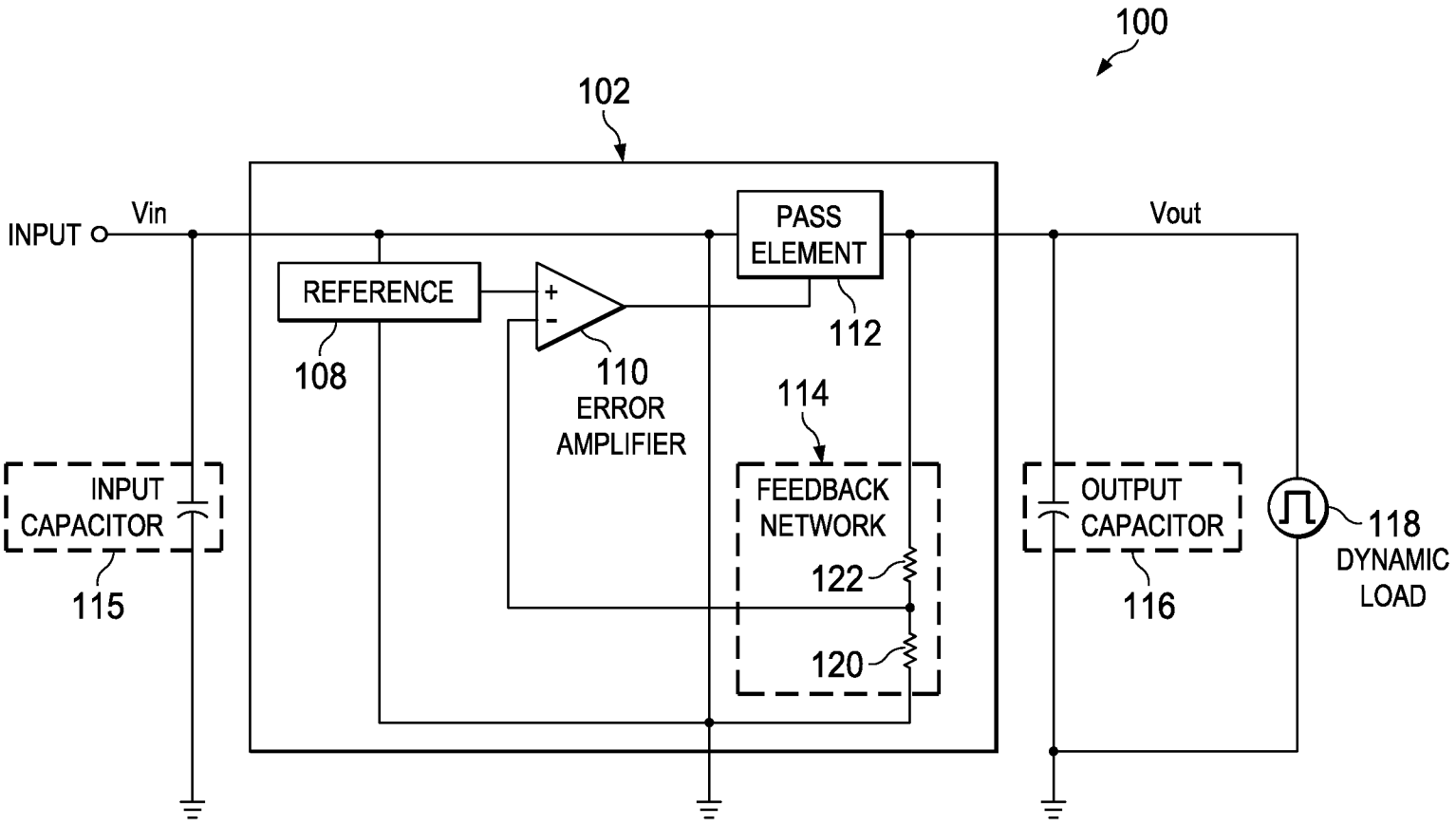
FIG. 1 (PRIOR ART)
FIG. 1 is a diagram illustrating an exemplary LDO.
Figure 2:
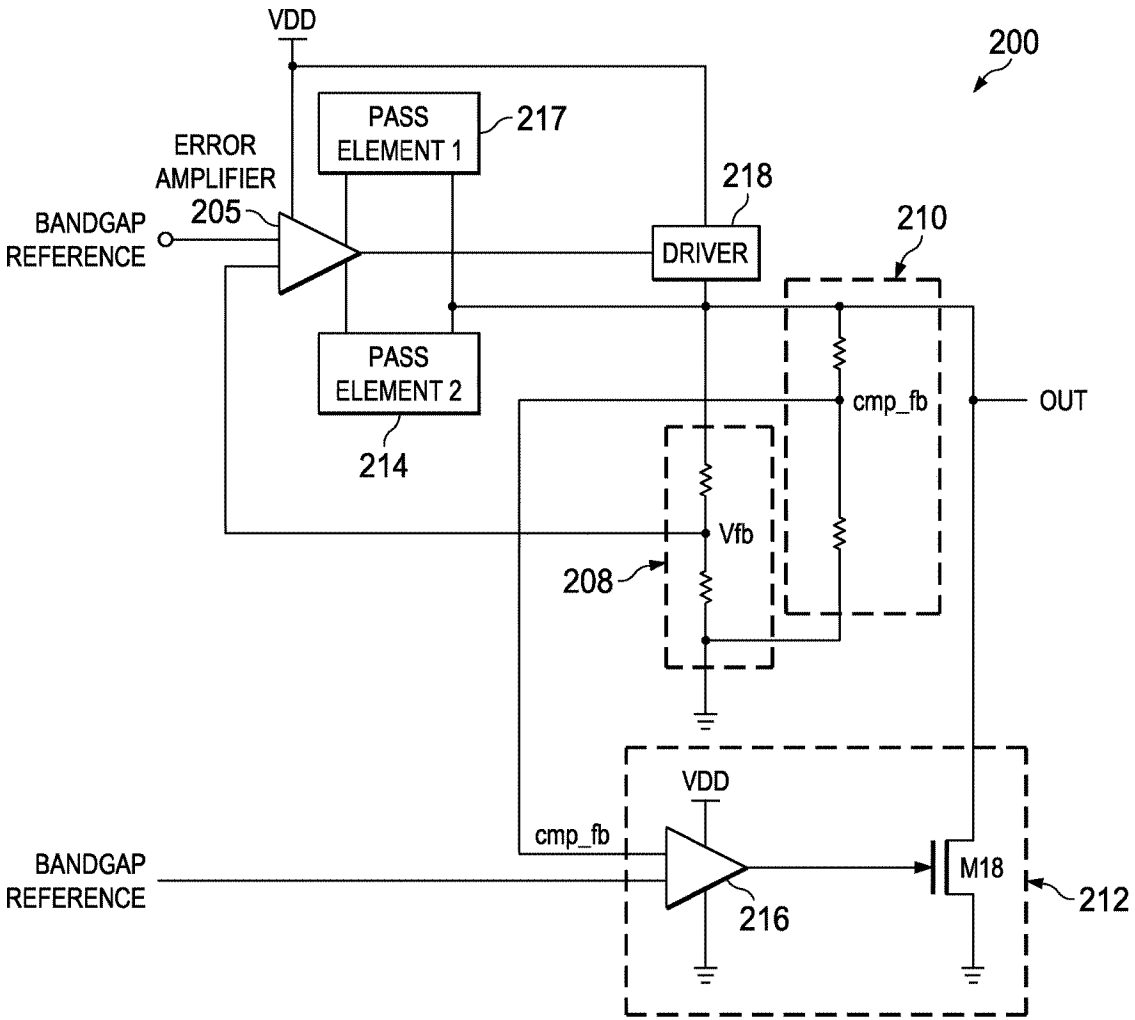
FIG. 2 is a diagram illustrating an exemplary LDO according to embodiment.

Turning now to FIG. 2, a diagram illustrating an exemplary LDO 200 in accordance with embodiments is shown. As will be discussed in greater detail below, the LDO 200 may control undershoot or voltage drop of the LDO regulator's output during fast incremental current load without an output capacitor; may control overshoot of the LDO regulator's output during fast decremental current load without an (internal or) external output capacitor; stabilize the error amplifier loop without an output capacitor; and reduce current consumption to less than 120 microamps.

As shown, the LDO regulator 200 includes an error amplifier 205, first and second pass elements 214, 217, driver 218, first and second resistor divider networks 208, 210, and overshoot protection circuit 212. As will be explained in greater detail below, in some embodiments, the pass element 214 may be embodied as a capacitor that transfers fast negative load transients at the output to a pair of common gate amplifiers (FIG. 3), which then feed the signal to the driver 218 to stabilize the output during voltage dips. Similarly, the pass element 217 may be embodied as a capacitor that transfers fast positive load transients at the output to a common gate amplifier, which feeds the signal to the input of the driver 218 to stabilize the output during voltage surges. The driver 218 may supply load current and may be controlled by the output of the error amplifier 205. In some embodiments, the common gate amplifiers are integrated with the error amplifier 205.

The error amplifier 205 may be implemented as a folded cascode amplifier. An overshoot protection circuit 212 includes a comparator 216 and transistor M18. The comparator 216 compares the bandgap reference with the output of a second resistor network 210 to quickly pull down the output by providing a discharge path. The transistor M18 is turned on whenever the output overshoots beyond its desired value and thus the output voltage is quickly pulled back to its original value. In some embodiments, the comparator 216 turns on the transistor when the output overshoots beyond 18 mV.

Broadly speaking, it is undesirable for the comparator 216 to become an amplifier in parallel to the main error amplifier 205 and cause the LDO 200 to oscillate. To prevent a simultaneous push-pull operation, in some embodiments, the comparator's positive input CMP_FB is typically 90% of the bandgap voltage. The bandgap voltage is connected to the comparator's negative input and so for normal DC operation, the output of the comparator is 0 and thus does not participate in loop regulation. The resistor divider network 210 provides the other input to the comparator 216.

Figure 3:
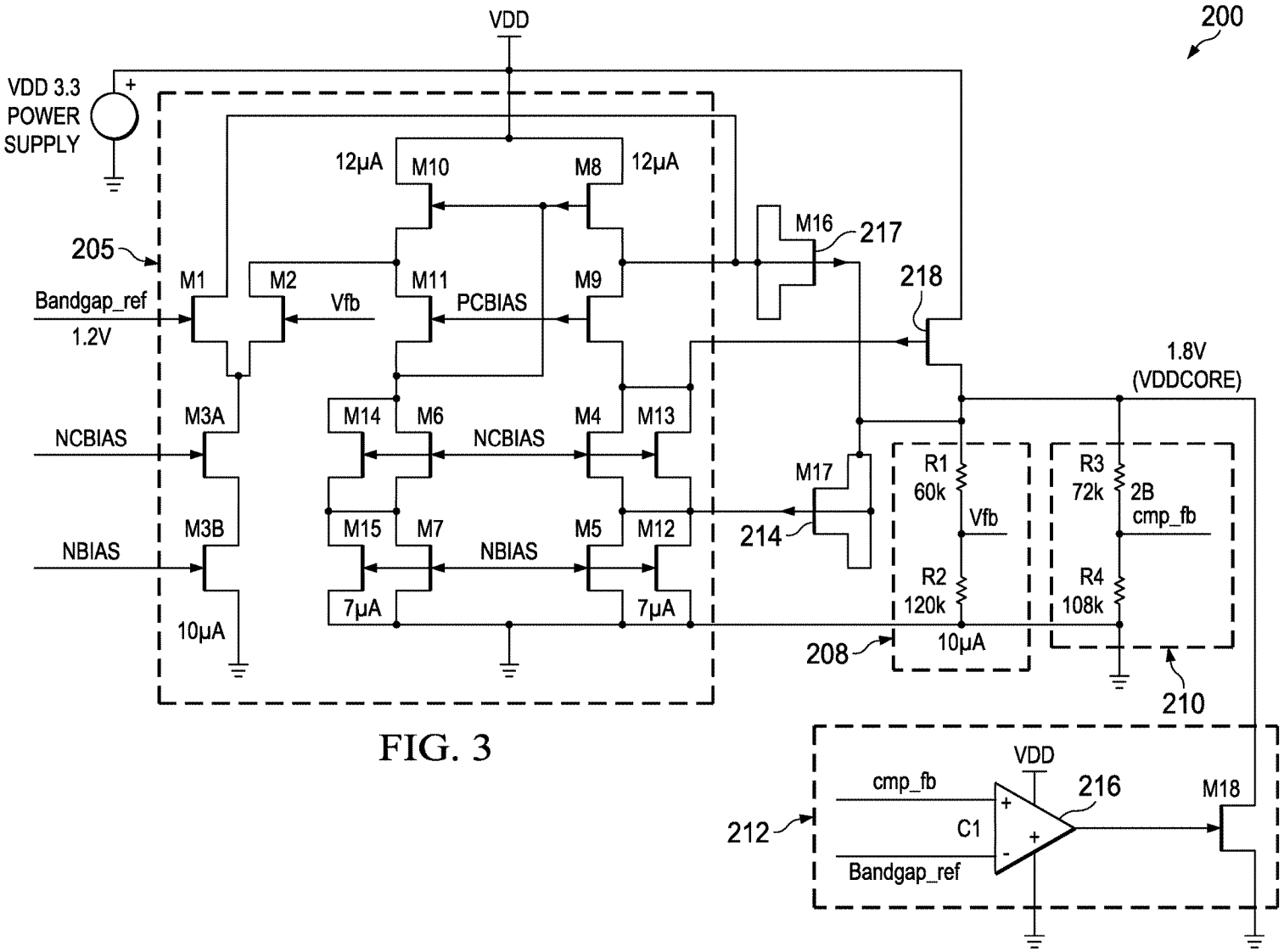
FIG. 3 is a diagram illustrating an exemplary LDO of FIG. 2 in greater detail.

As noted above, an aspect of embodiments is handling slow LDO response to fast incremental load transients. FIG. 3 illustrates in greater detail a circuit for doing so. As shown in FIG. 3, the error amplifier 200 may be implemented as a folded cascode amplifier. Further, in the embodiment illustrated, the pass elements 214, 217 are implemented as moscap transistors and the driver 218 may be a PMOS driver.

As shown, the error amplifier 205 receives as inputs the feedback voltage Vfb and the bandgap reference Vref. The differential input is coupled to the cascode stage between transistor M10, M11 and M8, M9, respectively, as well as moscap M16 (217). The folded cascode amplifier further includes transistors M4-M7 and M12-M15. Transistors M4, M5, M12, M13 are coupled to provide an output to the moscap M17 (214). Transistor M4, M13, and M9 couple to PMOS driver 218.

In operation, the moscap 214 formed by M17 transfers the output negative spike to the source terminal of the NMOS transistors M4, M13. The NMOS transistors M4, M13 function as a common gate amplifier to boost the output voltage by a gain of GmRo, where Gm is the transconductance of M4 and Ro is the small signal output impedance of M4, M13. The output of the common gate amplifier formed by M4 and M13 is several times greater than its input signal, which is fed to the gate of the PMOS driver 218, which helps the PMOS driver 218 quickly push large current into the output load and prevents the output voltage from a steep fall.

By pulling extra current through the NMOS load pair, the common gate amplifier M4, M13 is biased during large signal input differential signal operation and further aids the bandwidth of the common gate amplifier. Similarly, the moscap 217 (M16) transfers the output positive spike to the source of the M9 transistor, which acts as a common gate amplifier and feeds it to the input of the PMOS driver 218 to stabilize VDDCORE during voltage surges.

In this way, the AC stability of the LDO is improved, by creating a dominant pole along with the desired LHP zero. By using a common gate amplifier embedded with the folded cascode amplifier, the current consumption may be reduced to well below 120 uA for the worst corner and yet still achieve good transient response in high power mode. In addition, the pass elements 214, 217 provide frequency compensation for the LDO apart from the transient load response. Thus, the error amplifier 205 along with pass elements 214, 217 ensure a quick response to transient loads as well as ensure stability of the cap-less LDO.

Figure 4:
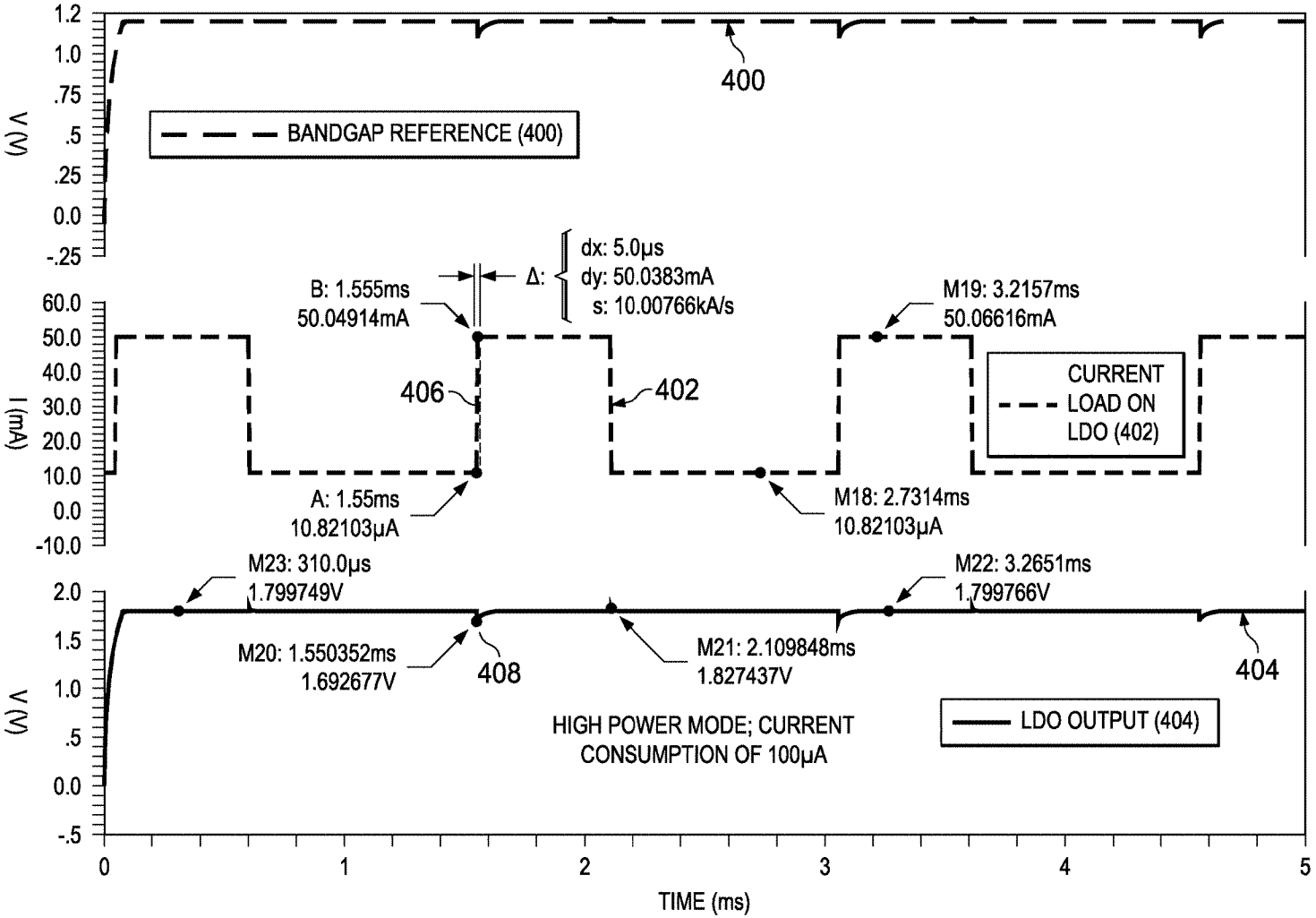
FIG. 4 is a plot of output voltage with respect to load current variation according to embodiments.

FIGS. 4-7 illustrate more particularly advantages of embodiments. FIG. 4 illustrates a graph 400 of a high power mode voltage swing. Shown at 402 is load current and shown at 404 is output voltage. As seen at 406, when the load current varies from 10 μA to 5 mA in 5 μs, the output voltage of the cap-less LDO varies by just 100 mV.

Figure 5:
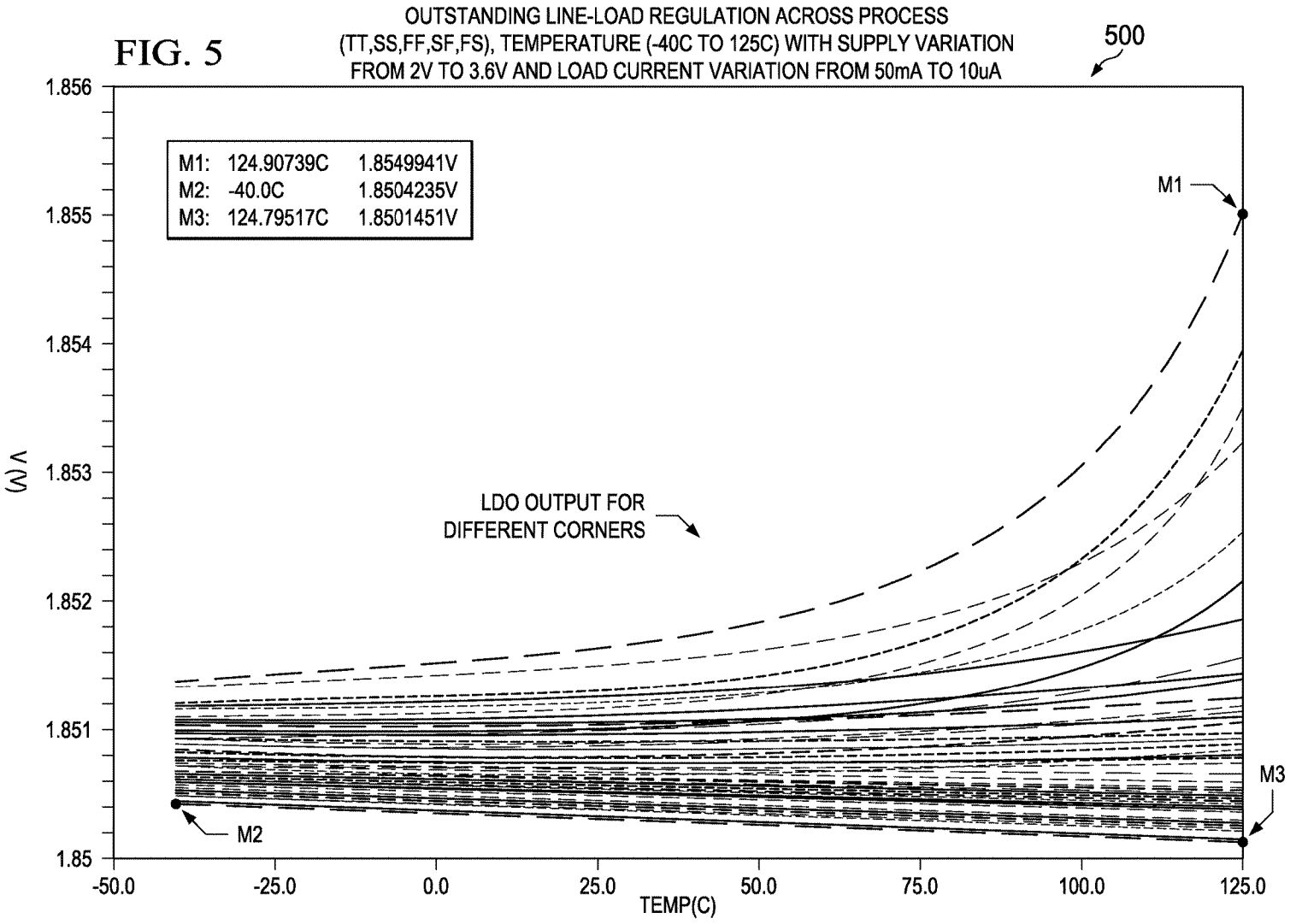
FIG. 5 is a plot of output voltage vs. temperature for various scenarios according to embodiments.

FIG. 5 shows a variety of output voltage vs. temperature plots, run according to various parameters, which indicate that the output of the cap-less LDO varies by less than 5 mV across Process (Typical, fast, slow, fast-slow, slow-fast), across temperature (−40 C to 125 C) across load current (10 uA to 50 mA) and across supply voltage (2V to 3.6V).

Figure 6:
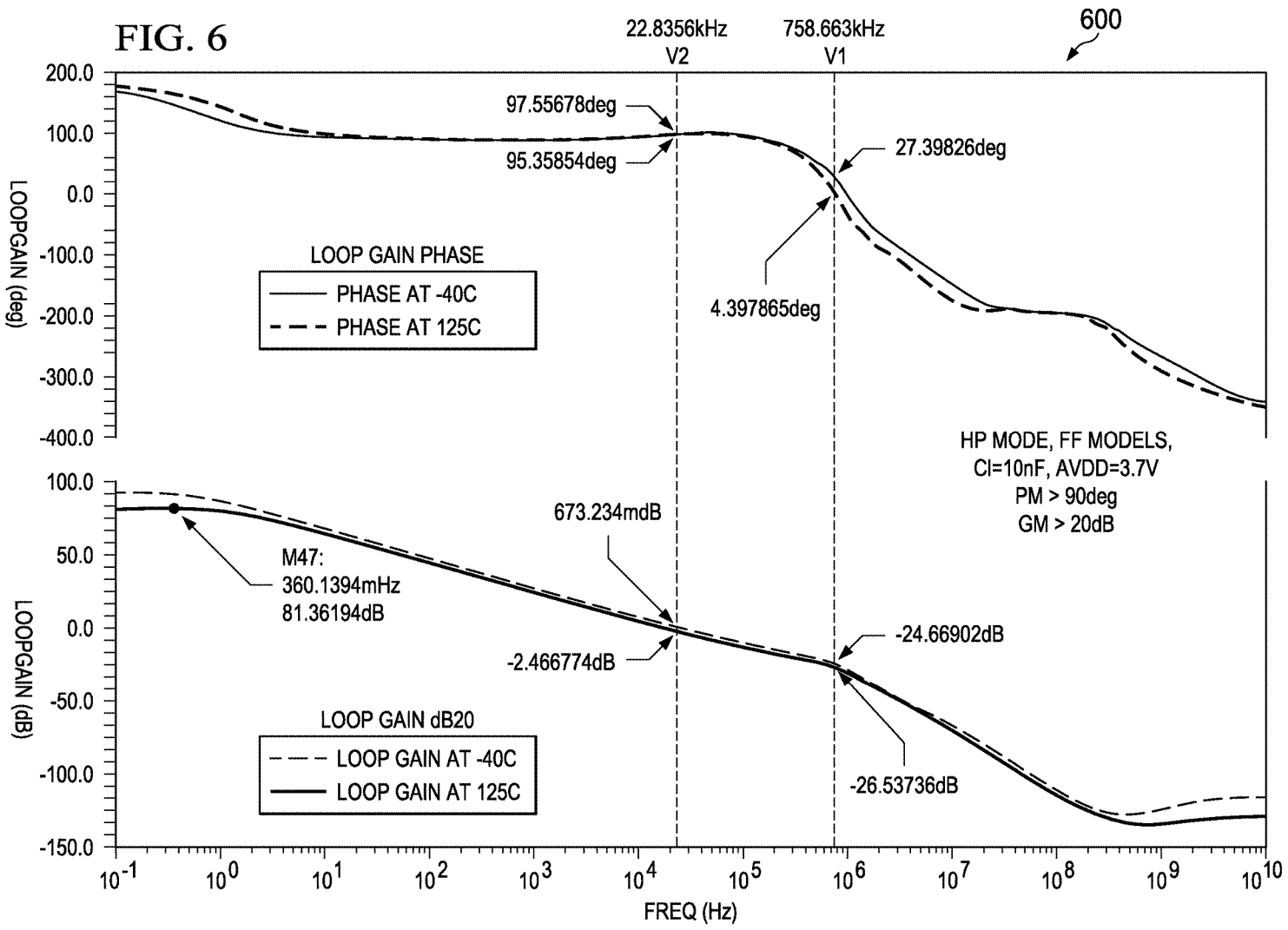
FIG. 6 is a Bode plot showing phase and gain margin according to embodiments.

FIG. 6 illustrates a Bode plot indicating that even at a worst process corner for stability (Fast), load capacitance of 10 nF (found normally in microcontrollers), supply voltage of 3.7V at a temperature of 100 C, the phase margin (PM) is greater than 90 Deg and Gain Margin (GM) is greater than 20 dB.

Figure 7:
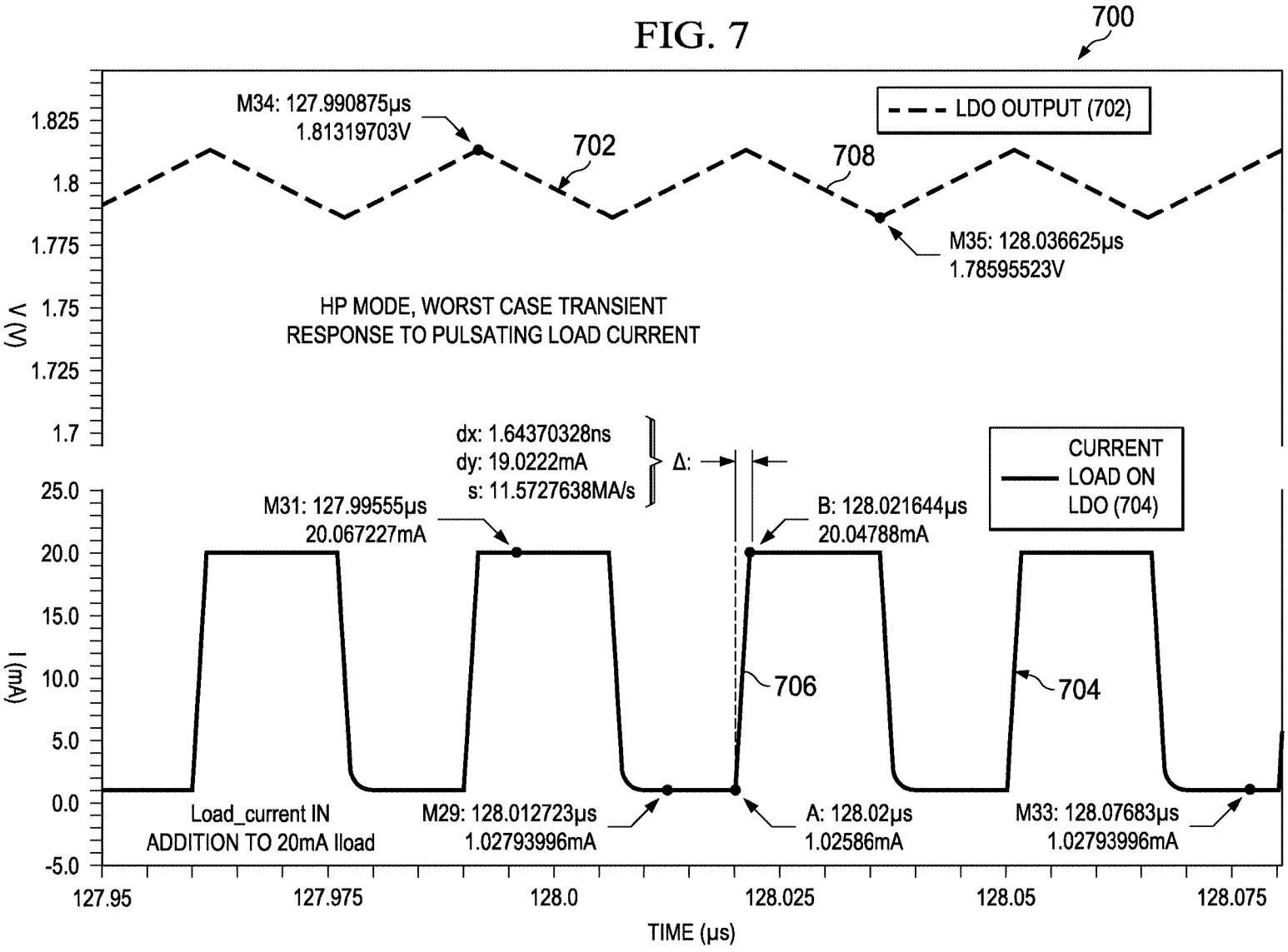
FIG. 7 is a plot of output voltage with respect to fast load current pulses according to embodiments.

Finally, shown in FIG. 7 is a graph 700 of a current pulse waveform 704 and output voltage 702. Shown at 706 is a fast load current pulse of 19 mA that transitions in just 1.6 nS. At 708, the effect on the output voltage is shown to be a variation of less than 130 mV.

Although the invention has been described with respect to specific embodiments thereof, these embodiments are merely illustrative, and not restrictive of the invention. The description herein of illustrated embodiments of the invention, including the description in the Abstract and Summary, is not intended to be exhaustive or to limit the invention to the precise forms disclosed herein (and in particular, the inclusion of any particular embodiment, feature or function within the Abstract or Summary is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function, including any such embodiment feature or function described in the Abstract or Summary.

While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Reference throughout this specification to "one embodiment", "an embodiment", or "a specific embodiment" or similar terminology means that a particular feature, structure, or characteristic described in connection with the embodiment is included in at least one embodiment and may not necessarily be present in all embodiments. Thus, respective appearances of the phrases "in one embodiment", "in an embodiment", or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

As used herein, the terms "comprises," "comprising," "includes," "including," "has," "having," or any other variation thereof, are intended to cover a non-exclusive inclusion. For example, a process, product, article, or apparatus that comprises a list of elements is not necessarily limited only those elements but may include other elements not expressly listed or inherent to such process, process, article, or apparatus.

Furthermore, the term "or" as used herein is generally intended to mean "and/or" unless otherwise indicated. For example, a condition A or B is satisfied by any one of the following: A is true (or present) and B is false (or not present), A is false (or not present) and B is true (or present), and both A and B are true (or present). As used herein, including the claims that follow, a term preceded by "a" or "an" (and "the" when antecedent basis is "a" or "an") includes both singular and plural of such term, unless clearly indicated within the claim otherwise (i.e., that the reference "a" or "an" clearly indicates only the singular or only the plural). Also, as used in the description herein and throughout the claims that follow, the meaning of "in" includes "in" and "on" unless the context clearly dictates otherwise.

It will be appreciated that one or more of the elements depicted in the drawings/figures can also be implemented in a more separated or integrated manner, or even removed or rendered as inoperable in certain cases, as is useful in accordance with a particular application. Additionally, any signal arrows in the drawings/Figures should be considered only as exemplary, and not limiting, unless otherwise specifically noted.

What is claimed is:

1. A low drop out (LDO) regulator, comprising:

an error amplifier configured to receive a bandgap reference input;

first and second pass transistors configured to receive outputs from the error amplifier;

first and second resistor feedback networks, the first resistor feedback network configured to provide a feedback output as an input to the error amplifier;

an overshoot protection circuit coupled to the second resistor feedback network and configured to control the output; and an output connected to the pass transistors and the first resistor feedback network and the second resister feedback network;

wherein the LDO regulator is configured to control undershoot or voltage drop of the regulator's output during incremental current load without an output capacitor.

2. The LDO regulator of claim 1, further including a driver coupled between the error amplifier and the output.

3. The LDO regulator of claim 1, wherein the second resistor feedback network is configured to provide a comparator feedback output as an input to the overshoot protection circuit.

4. The LDO regulator of claim 3, wherein the overshoot protection circuit includes a comparator configured to compare the comparator feedback output and the bandgap reference input.

5. The LDO regulator of claim 4, wherein the first pass transistor implements a capacitor at the output of the error amplifier to compensate for slow response.

6. The LDO regulator of claim 3, wherein the error amplifier comprises a folded cascode amplifier.

7. The LDO regulator of claim 6, wherein the second pass transistor implements a capacitor coupled to a differential pair input circuit of the folded cascode amplifier.

8. The LDO regulator of claim 1, wherein the overshoot protection circuit and the error amplifier are connected to a VDD source.

9. The LDO regulator of claim 1, wherein:

the overshoot protection circuit includes a comparator and a transistor coupled to an output of the comparator;

the comparator is coupled to a VDD source; and the transistor is coupled to the output.

10. The LDO regulator of claim 1, wherein:

the overshoot protection circuit includes a comparator;

comparator circuitry of the comparator is configured to compare a comparator feedback output and the bandgap reference input; and the comparator circuitry is powered by a VDD source.

11. An integrated circuit including a low drop out (LDO) regulator configured to implement transient response and loop stability, comprising:

an error amplifier configured to receive a bandgap reference input;

first and second pass elements configured to receive outputs from the error amplifier;

first and second resistor feedback networks, the first resistor feedback network configured to provide a feedback output as an input to the error amplifier;

an output connected to the first and second pass elements and the first resistor feedback network and the second resistor feedback network;

an overshoot protection circuit coupled to the second resistor feedback network and configured to control the output;

wherein the integrated circuit is configured to implement the LDO regulator to control undershoot or voltage drop of the LDO regulator's output during incremental current load without an output capacitor.

12. The integrated circuit of claim 11, further including a driver coupled between the error amplifier and the output.

13. The integrated circuit of claim 11, wherein the second resistor feedback network is configured to provide a comparator feedback output as an input to the overshoot protection circuit.

14. The integrated circuit of claim 13, wherein the overshoot protection circuit includes a comparator configured to compare the comparator feedback output and the bandgap reference input.

15. The integrated circuit of claim 11, wherein the error amplifier comprises a folded cascode amplifier.

16. The integrated circuit of claim 15, wherein the first pass element implements a capacitor at the output of the error amplifier to compensate for slow response.

17. The integrated circuit of claim 16, wherein the second pass element implements a capacitor coupled to a differential pair input circuit of the folded cascode amplifier.

18. A method for providing a low drop out (LDO) regulator configured to implement transient response and loop stability, comprising:

providing an error amplifier configured to receive a bandgap reference input;

providing first and second pass elements configured to receive outputs from the error amplifier;

providing first and second resistor feedback networks, the first resistor feedback network configured to provide a feedback output as an input to the error amplifier;

providing an overshoot protection circuit with respect to the second resistor feedback network; and providing an output connected to the pass transistors, the output coupled to the first resistor feedback network and the second resistor feedback network, wherein the overshoot protection circuit controls the output;

wherein the LDO regulator is configured to control undershoot or voltage drop of the regulator's output during incremental current load without an output capacitor.

19. The method of claim 18, further including providing a driver coupled between the error amplifier and the output.

20. The method of claim 18, wherein the second resistor feedback network is configured to provide a comparator feedback output as an input to the overshoot protection circuit.

21. The method of claim 20, wherein the overshoot protection circuit includes a comparator configured to compare the comparator feedback output and the bandgap reference input.

22. The method of claim 21, wherein the first pass element implements a capacitor at the output of the error amplifier to compensate for slow response.

23. The method of claim 20, wherein the error amplifier comprises a folded cascode amplifier.

24. The method of claim 23, wherein the second pass element implements a capacitor coupled to a differential pair input circuit of the folded cascode amplifier.

* * * * *